US006626555B2

(12) United States Patent
Yaeger

(10) Patent No.: US 6,626,555 B2
(45) Date of Patent: Sep. 30, 2003

(54) PORTABLE ILLUMINATION DEVICE

(76) Inventor: Rob Yaeger, 18255—197th St., Big Lake, MN (US) 55309

( * ) Notice: Subject to any disclaimer, the term of this patent is extended or adjusted under 35 U.S.C. 154(b) by 29 days.

(21) Appl. No.: 09/729,497

(22) Filed: Dec. 4, 2000

(65) Prior Publication Data

US 2002/0067611 A1 Jun. 6, 2002

(51) Int. Cl.[7] ..... F21L 4/02

(52) U.S. Cl. ..... 362/187; 362/167; 362/168; 362/195; 362/190; 362/191; 362/200; 362/203; 362/205

(58) Field of Search ..... 362/184, 167, 362/168, 195, 197, 200, 203, 205, 190, 191

(56) References Cited

U.S. PATENT DOCUMENTS

| | | | | |
|---|---|---|---|---|
| 1,276,311 A | | 8/1918 | Armbruster | |
| 1,318,850 A | | 10/1919 | De Yong | |
| 1,349,312 A | | 8/1920 | Barrett | |
| 1,540,372 A | | 6/1925 | Sears | |
| 2,354,853 A | | 8/1944 | Dobbs | |
| 2,804,538 A | | 8/1957 | Leone | |
| 2,992,487 A | | 7/1961 | Miller | |
| 3,365,153 A | | 1/1968 | Baucom | |
| 4,214,688 A | | 7/1980 | Griffin, Jr. | |
| 4,462,160 A | | 7/1984 | Cohen et al. | |
| 4,516,325 A | * | 5/1985 | Cohen et al. | 33/760 |
| 4,580,347 A | | 4/1986 | McKnight | |
| 4,827,389 A | | 5/1989 | Crum | |
| 5,051,876 A | | 9/1991 | Norman | |
| 5,149,190 A | * | 9/1992 | MacKenzie | 362/234 |
| 5,199,780 A | | 4/1993 | Ekman | |
| 5,213,413 A | | 5/1993 | Weathers | |
| 5,388,741 A | | 2/1995 | Hillinger | |
| 5,418,701 A | | 5/1995 | Hart | |
| 5,425,931 A | | 6/1995 | Wheeler | |
| 5,430,952 A | | 7/1995 | Betts | |
| 5,544,420 A | | 8/1996 | Choi | |
| 5,548,496 A | | 8/1996 | Hart et al. | |
| 5,577,829 A | | 11/1996 | Hall | |
| 5,641,220 A | | 6/1997 | Sutherland et al. | |
| 5,769,535 A | | 6/1998 | Rominger et al. | |
| 5,826,969 A | | 10/1998 | Nevin | |
| 5,836,679 A | | 11/1998 | Klamm | |
| 5,954,458 A | | 9/1999 | Lee | |
| 5,988,828 A | | 11/1999 | Prince et al. | |
| 6,043,868 A | | 3/2000 | Dunne | |
| 6,050,694 A | | 4/2000 | Confrey | |
| 6,053,936 A | * | 4/2000 | Koyama | 607/88 |
| 6,106,136 A | | 8/2000 | Lin | |

* cited by examiner

*Primary Examiner*—Sandra O'Shea
*Assistant Examiner*—Bertrand Zeade
(74) *Attorney, Agent, or Firm*—Haugen Law Firm PLLP

(57) ABSTRACT

A portable illumination device for illuminating a target zone includes an outer frame having illumination means disposed at least partially therein, and attachment means for removably attaching the illumination device through desired objects, with the attachment means being formed integral with the outer frame. In a particular embodiment, the portable illumination device includes multiple light emitting diodes which are specifically positioned and directed to illuminate distinct target zones. The portable illumination device may be removably attached to a variety of regularly and irregularly shaped objects.

24 Claims, 4 Drawing Sheets

10
34
12
28
18
30
32
32
14
20
16
22

60
50
58
54
56
62

74
70
76
78
80
72
80

102
108
104
106
108

120
122
126
128
124

130
138
136
132
104
134

PORTABLE ILLUMINATION DEVICE

FIELD OF THE INVENTION

The present invention relates to illumination devices generally, and more particularly to portable illumination devices for removable attachment to various objects. This invention also relates to methods for removably attaching portable illumination devices to various objects.

BACKGROUND OF THE INVENTION

A variety of illumination devices have been implemented to illuminate areas which receive no or insufficient light for human utilization. Most commonly, artificial means have been used to illuminate such areas. Some of the devices that have been developed to provide such portable illumination include electric or oil lanterns, self-supporting lights, and individual lighting units powered by batteries or electrical cords.

A particular application for such illumination means is in illuminating desired areas for inspection and/or manipulation, where traditional lighting systems are not available. Relatively compact illumination devices, therefore, have become desirable for such purposes.

Flashlights, in particular, have become very popular in such situations for their relative portability and low cost. One of the most common applications for such flashlights is in typical household maintenance and construction, though a wide variety of other flashlight applications are used on a daily basis. Often times, the flashlight operator utilizes the flashlight to illuminate an area in which tools or other implements are being utilized. To effectively manipulate such tools, the operator has traditionally needed to position the flashlight such that the flashlight illuminates the work area without requiring the user to continuously hold the flashlight. However, most portable flashlights project a relatively narrow illumination beam, thereby forcing the user to repeatedly re-direct and re-position the flashlight to illuminate desired areas. Thus, a need arose for a means of directing an illumination beam from a flashlight without requiring continuous manipulation from the user's hands.

A number of mechanisms have been introduced which are designed to grasp conventional flashlights, and to be placed in various positions to more effectively illuminate desired areas. Examples of such devices are described in U.S. Pat. Nos. 4,214,688, 2,354,853, and 1,540,372. Such devices provide means for gripping conventional flashlights such that user manipulation is not required, thereby freeing the users hands to perform other tasks. However, such devices typically have limited uses, and may not be universally adapted to function in various applications.

Portable illumination mechanisms proposed to date have not addressed the issue of having a lightweight device that may be removably attached to various objects such that the object may still be used for their intended purpose while having such an illumination device attached thereto. Furthermore, no such device has been proposed which incorporates an attachment means in the body of the portable illumination device itself, so that a single illumination device may be easily transferred to and from several receptacle objects.

Accordingly, it is a principle object of the present invention to provide a portable illumination device having attachment means integrated therein for removable attachment of the illumination device to various objects.

A further object of the present invention is to provide a portable illumination device that may be easily secured to and removed from small objects without interfering with the intended functionality of such objects.

A still further object of the present invention is to provide a compact, portable illumination device that is removably attachable to various hand tools, including tape measures.

A yet further object of the present invention is to provide a portable illumination device having universal attachment means integrated therein.

Another object of the present invention is to provide a portable illumination device which incorporates a plurality of distinct illumination means.

A still further object of the present invention is to provide a portable illumination device which incorporates multi-directional illumination means, each of which illumination means has a distinct illuminatory purpose.

A yet further object of the present invention is to provide a portable illumination device which incorporates a plurality of illumination means each emitting designated illumination wavelengths.

A still further object of the present invention is to provide a portable illumination device incorporating one or more light emitting diodes (LED).

SUMMARY OF THE INVENTION

By means of the present invention, portable illumination is enhanced by providing an illumination device having attachment means integrated therein for removable attachment of the illumination device to various objects. Furthermore, such a portable illumination device may be utilized in a manner so as to avoid interfering with intended functionality of respective objects that the device is removably attached to. Such objects include everyday tools such as tape measures, saws, drills, nail guns, screw guns, as well as other common objects such as toolboxes, clothing belts, walls, and building studs. The portable illumination device of the present invention preferably utilizes one or more types of illumination elements, including light emitting diodes, incandescent lights, fluorescent lights, or other gas-charged lighting elements. Such illumination elements are preferably positioned in the illumination device and directed to illuminate specific target areas.

One embodiment of the portable illumination device of the present invention includes an outer frame having illumination means disposed at least partially therein, and attachment means for removably attaching the illumination device to desired objects, with the attachment means being formed integral with the outer frame. The device is preferably sized and configured to receive specific securing means which are connected to the desired objects. The attachment means may include one or more slots which are sized and configured to receive securing means being made up of protrusions sized and configured accordingly. The illumination means of the device may include one or more individual light emitting diodes (LED), wherein the light emitting diodes may illuminate in one or more distinct colors. The device may be particularly sized and configured to be removably attachable to a side surface of a tape measure such that the illumination device does not interfere with the functionality of the tape measure.

The present invention also contemplates a method of illuminating a target zone. The method includes providing a portable illumination device having attachment means formed integral therewith, and a securing means that is sized and configured to receive the attachment means. The method further includes connecting the securing means to a desired object, removably attaching the illumination device to the securing means via the attachment means, and actuating the illumination means. The illumination device of the present invention may also be utilized independent of the securing means, such that the illumination device is actuatable and directable in a variety of hand-held applications.

DETAILED DESCRIPTION OF THE PREFERRED EMBODIMENTS

The objects and advantages enumerated above together with other objects, features and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
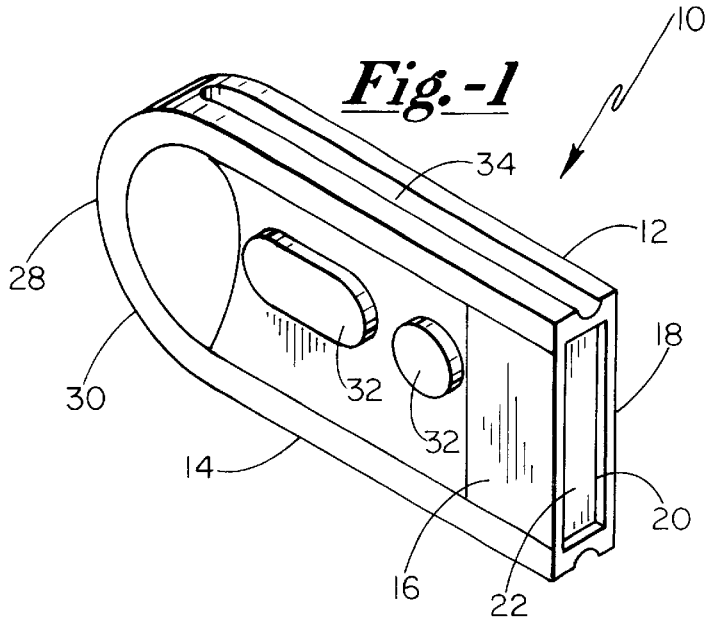
FIG. 1 is an isometric view illustrating a portable illumination device of the present invention.

Referring now by characters of reference to the drawings, and first to FIG. 1, a portable illumination device 10 is shown. Illumination device 10 includes a top-side 12, a generally opposing bottom side 14, and first and second sides 16, 18 respectively therebetween. Illumination device 10 further includes an illumination end 20 having one or more light-permeable lenses 22 therein, and an enclosed end 28. The above-described sides and ends generally form an outer frame 30 of illumination device 10.

Illumination device 10 preferably includes one or more actuators switches 32, which actuator switches actuate one or more light sources (not shown) positioned at least partially within outer frame 30. Actuator switch 32 may comprise any convenient actuating means such as a push-button, a toggle switch, or a multi-positional switch. In preferred embodiments, actuator switch 32 may actuate one or more distinct illumination elements (not shown), either simultaneously or sequentially, and may control illumination element intensity of respective distinct illumination elements. In a preferred embodiment, actuator switch 32 is a multi-position switch that alternately and/or sequentially actuates one or more of a plurality of illumination elements.

As shown in the embodiment of FIG. 1, illumination device 10 includes a light-permeable lens 22 through which light from respective illumination elements may be transmitted. Lens 22 may be of any desired material which suitably transmits desired light, and is preferably a transparent polymer material. Lens 22 may include a color tinting to provide desired illumination effects. In some embodiments of the present invention, a plurality of light-permeable lenses may be utilized to transmit light emitted from individual respective illumination elements. Such multiple light-permeable lenses are shown at 54 in FIG. 2. In other embodiments of the present invention, individual illumination elements may protrude from outer frame 30.

As shown in FIG. 1, illumination device 10 preferably includes one or more receiving slots 34 for receiving associated securing means, which securing means are preferably connected to desired objects. In the embodiment of FIG. 1, receiving slots 34 are formed in respective top and bottom sides 12, 14, and are sized and configured to receive specific associated securing means. Preferably, receiving slots 34 slidingly engage respective securing means such that illumination device 10 is securely held by such securing means. Receiving slots 34 may embody a variety of configurations, with the only requirement being that such receiving slots 34 be sized and configured to receive respective securing means, either slidably or otherwise. The present invention also contemplates an illumination device 10 having one or more protrusions which may be received by respective securing means connected to desired objects. Such protrusions may be slidably or otherwise received into recesses, bores, or slots in respective securing means. Most preferably, receiving slots 34 are utilized in respective illumination devices of the present invention such that a primary utility of illumination device portability may be utilized without having cumbersome protrusions or other such attachment devices secured thereto. Thus, illumination device 10 may be easily used as a portable, hand-held illumination device, while retaining the desired functionality of being removably attachable to a variety of desired objects.

Figure 2:
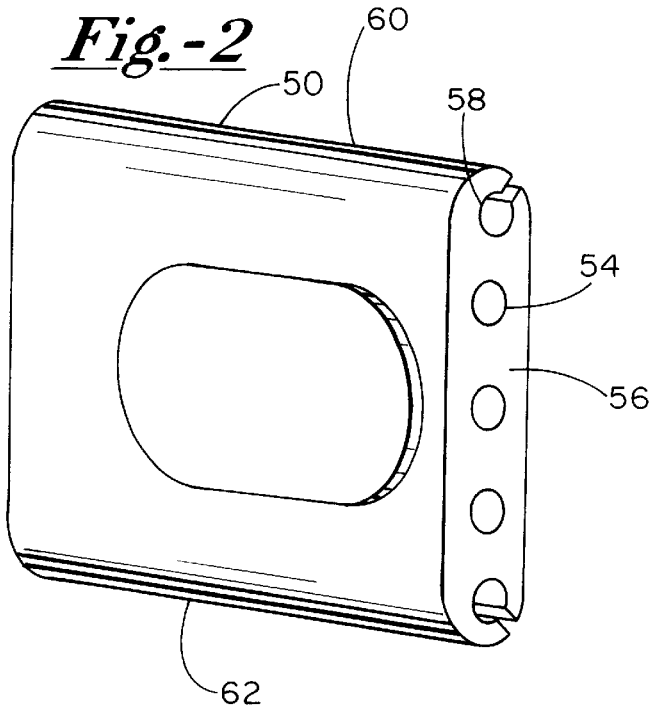
FIG. 2 is an isometric view of an alternative embodiment of a portable illumination device of the present invention.

An alternative embodiment of the present invention is shown in FIG. 2. In the embodiment shown in FIG. 2, a plurality of light-permeable lenses 54 are shown disposed in a respective end 56 of outer frame 50. Light-permeable lenses 54 are shown in FIG. 2 as being vertically-oriented along end 56, but may be arranged in any suitable orientation. The illumination device of FIG. 2 includes receiving channels 58 for receiving associated protrusions in respective securing means. Preferably, the illumination device is slidingly engaged upon respective securing means through receiving channels 58. The illumination device of FIG. 2 further includes rounded top and bottom sides 60, 62 for gripping ease when the illumination device is being utilized separately from respective securing means.

Figure 3:
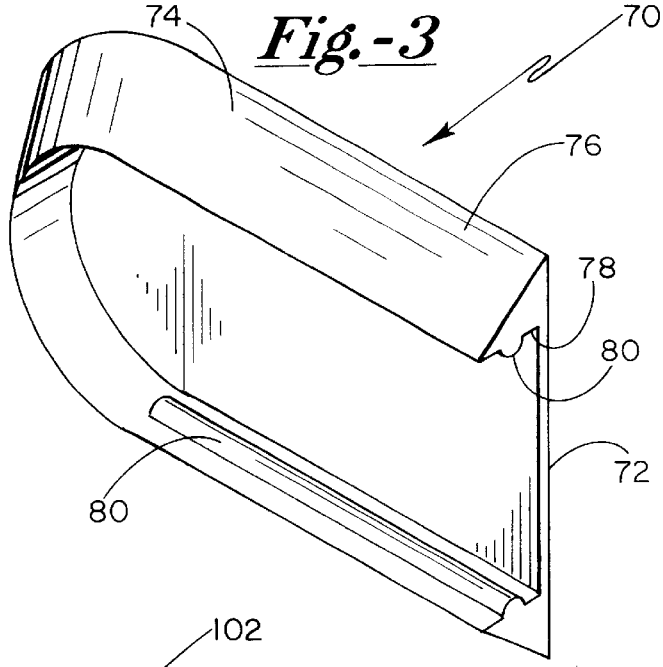
FIG. 3 is an isometric view of a securing means of the present invention.

An embodiment of a securing means of the present invention is shown in FIG. 3, and is denoted at 70. Securing means 70 includes a substantially flat side 72, which side 72 may be secured to relatively flat surfaces of respective desired objects. Securing means 70 may be connected to respective desired objects by adhesives, Velcro®, or any other mechanical or chemical attachment devices which effectively connect securing means 70 to the respective objects, either temporarily or permanently. In preferred embodiments, securing means 70 is adhesively connected to respective surfaces of the desired objects.

Securing means 70 further includes receiving walls 74, which receiving walls extend outwardly from side 72, and have respective outer and generally opposing inner surfaces 76, 78, respectively. At least a portion of inner surface 78 of receiving walls 74 preferably include one or more protrusions 80 extending therefrom, which protrusions 80 are preferably sized and configured to mate with respective receiving slots 34. Preferably, receiving slots 34 are slidably engaged with protrusions 80 to thereby secure illumination device 10 within walls 74 of securing means 70. In preferred embodiments, walls 74 are shaped so as to conform to outer frame 30 of illumination device 10.

In some embodiments of the present invention, side 72 of securing means 70 may be curved to conform to curved surfaces of respective desired objects unto which securing means 70 may be connected. In other embodiments, side 72 may be fabricated of a flexible material, whereby securing means 70 may conform to irregular surfaces of respective desired objects. Securing means 70 is preferably a polymeric material, but may also comprise flexible material such as rubberized plastic, vulcanized polymers, or durable woven or nonwoven materials. Securing means 70 may also comprise other materials, so long as securing means 70 is relatively durable, and has sufficient strength and rigidity to firmly secure illumination device 10 therein.

Figure 4:
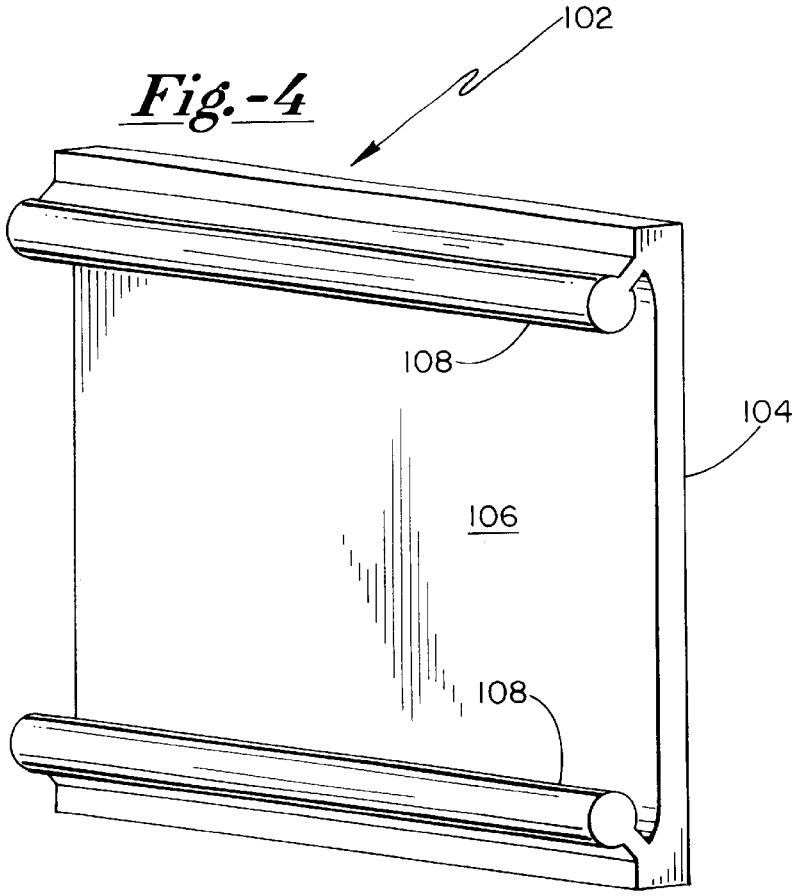
FIG. 4 is an isometric view of an alternative embodiment of a securing means of the present invention.

An alternative securing means 102 is shown in FIG. 4. Securing means 102 preferably includes an inner surface 104, and an outer surface 106, which inner surface 104 may be attached to respective desired objects, either temporarily or permanently. Securing means 102 further includes one or more protrusions 108 extending outwardly from outer surface 106, and extending along a length of outer surface 106. Protrusions 108 are preferably sized and configured to mate with respective receiving channels 58 in the illumination device. As shown in FIG. 4, protrusions 108 preferably extend from surface 106 at an angle less than 90 degrees with respect to side 106. Such angular extension provides for firm engagement of the illumination device with securing means 102. Protrusions 108 may embody a variety of configurations, so long as protrusions 108 are sized and configured to mate with respective receiving channels 58.

As in securing means 70, inner surface 104 of securing means 102 may be curved to meet specific surface configurations of respective desired objects that the securing means may be adhered to. In other embodiments, securing means 102 may be fabricated from a relatively flexible material such that securing means 102 may conform to irregular surfaces on respective desired objects.

Figure 5:
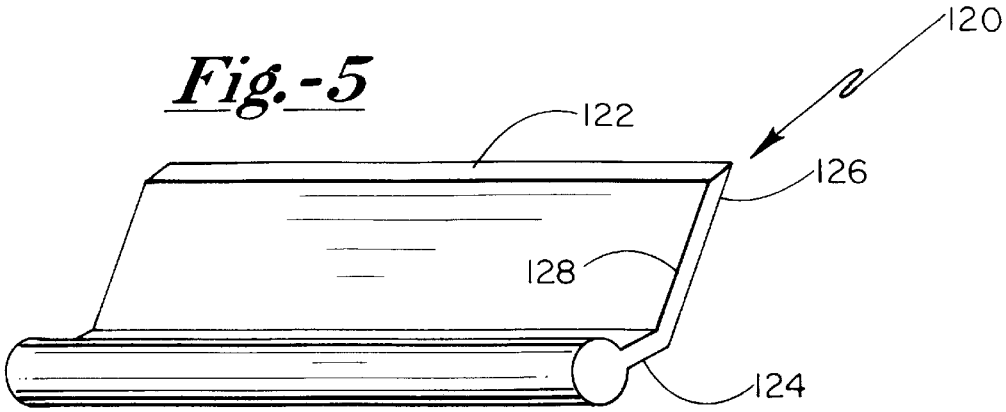
FIG. 5 is an isometric view of an alternative embodiment of a securing means of the present invention.

An additional securing means embodiment is shown in FIG. 5, and designated at 120. Securing means 120 includes a flange portion 122 and a protrusion 124 extending therefrom. Flange portion 122 preferably includes an inner surface 126 and a generally opposing outer surface 128. Inner surface 126 of flange portion 122 is preferably attached to respective desired objects, either temporarily or permanently. Protrusion 124 is preferably sized and configured to mate with respective receiving channel 58 in the illumination device. Securing means 120 may comprise two or more of the elements shown to effectively secure the illumination device. In preferred embodiments, two securing means 120 are positioned on a respective surface or surfaces of a desired object such that the illumination device may be removably secured thereto. Such securing means 120 provide the user with the ability to position such securing means on desired object surfaces where a single attaching surface is not useful. Examples of situations wherein securing means 120 are useful include object surfaces having undulations or rises in between placement location of such securing means 120.

Figure 6:
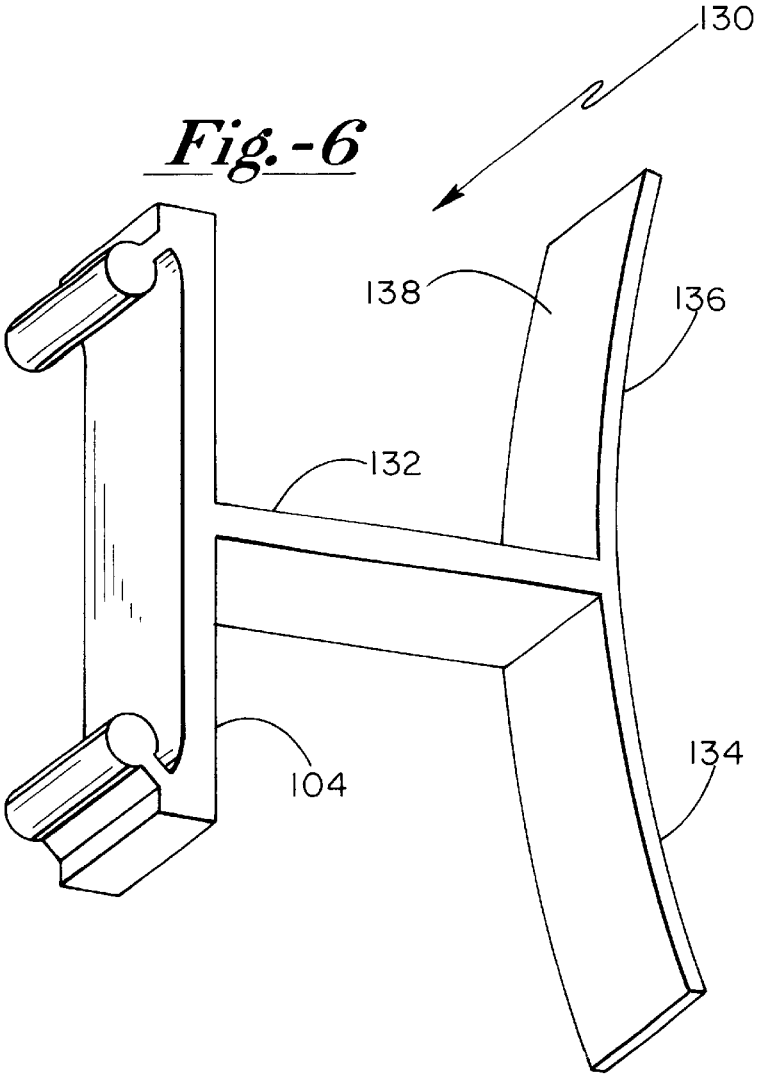
FIG. 6 is an isometric view of an alternative embodiment of a securing means of the present invention.

Another alternative securing means embodiment is illustrated in FIG. 6, and designated at 130. Securing means 130 is similar to securing means 102, but includes an extension number 132 extending from inner surface 104. Integral with, or connected to extension member 132 is an attachment member 134, which attachment member 134 may be curved. Attachment member 134 preferably includes an inner surface 136 and a generally opposing outer surface 138, which inner surface 136 is preferably adhesively attached to respective surfaces of desired objects unto which securing means 130 is to be attached, either temporarily or permanently. As in other embodiments of the invention, securing means 130 may be attached to desired objects through means other than adhesives. Attachment member 134 may be fabricated from a relatively flexible material such that attachment member 134 may conform to irregularly shaped surfaces of respective desired objects. Extension member 132 provides the added utility of extending the securing means 130 from respective object surfaces, so that the illumination device may be removably attached to securing means 130 at a position away from the desired object.

In preferred embodiments, respective securing means are attached, either temporarily or permanently, to respective surfaces of the desired object in such a manner so that the illumination device received therein is desirably oriented. However, some embodiments of the present invention contemplate an illumination device having directable illumination means such that securing means positioning on respective desired objects is not critical to the ultimate functionality of the present invention.

Illumination means (not shown) may comprise a variety of distinct illumination elements. In preferred embodiments of the present invention, the illumination means include one or more individual light emitting diodes (LED), which LEDs may illuminate in one or more colors. Preferably, such LEDs each illuminate in a distinct color. In some embodiments, a plurality of LEDs illuminate in a single color while other LEDs illuminate in other colors. Preferably, specific LED colors are included in the illumination device for particular desired applications. For example, a green LED is preferably included in the illumination device for advantageously illuminating standard measuring tapes, which are typically yellow in color. The green LED desirably brightly illuminates yellow measuring tapes or other yellow objects when directed thereon. Other LED illumination colors are also preferably included in the illumination device to best illuminate desired targets. In a preferred embodiment, at least one green LED and at least one white LED is included in the illumination device.

Other means for illumination may be utilized in the illumination device, such as incandescent lights, or fluorescent lights, or other gas-charged illumination elements. LED lights are particularly preferred for their high intensity and compact size. Such light elements are preferably energized by compact batteries stored within or adjacent to the illumination device. Such batteries are preferably stored integrally with the illumination device so that the illumination device retains its portable characteristics.

Figure 7:
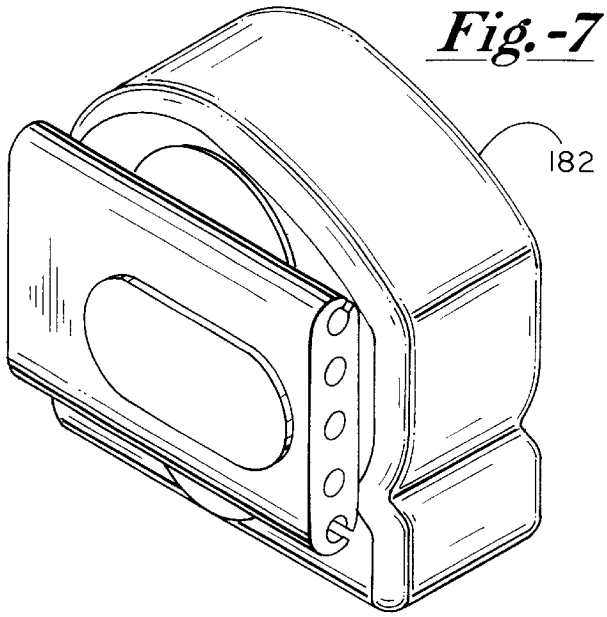
FIG. 7 is an isometric view of a portable illumination device of the present invention being removably attachable to a tape measure.

In a particular and preferred embodiment of the present invention, the illumination device is sized and configured to be removably attached to a side surface of common tape measure devices. FIG. 7 illustrates such an illumination device of the present invention, which is adaptive to be removably attached to a tape measure 182. In such an embodiment, the illumination means are preferably directed to illuminate the extended measuring tape, as well as a target area in which the tape measure is to be used. In preferred embodiments, a green LED is directed to illuminate the extended measuring tape, and white LEDs or other illumination means are directed to illuminate the work area.

Figure 8:
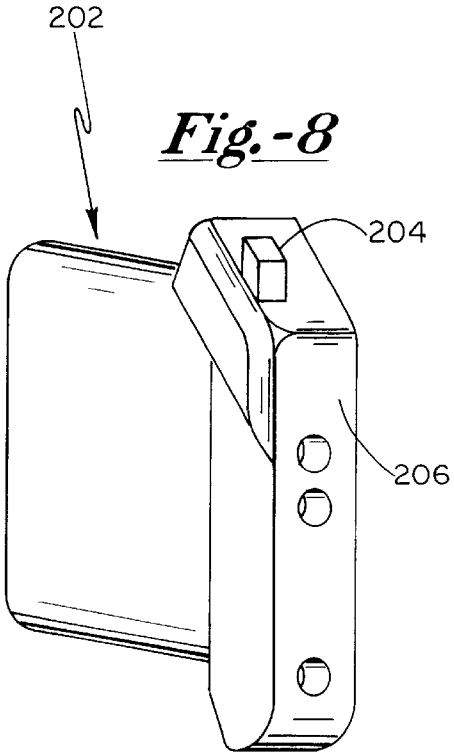
FIG. 8 is an isometric view of an alternative embodiment of a portable illumination device of the present invention.
Figure 9:
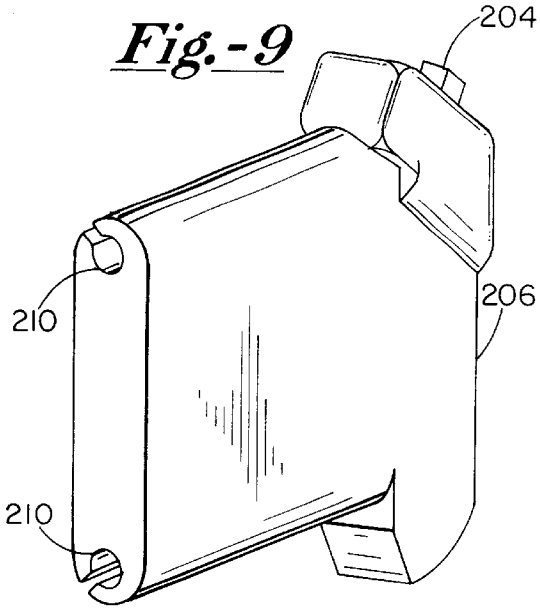
FIG. 9 is a rear isometric view of the embodiment shown in FIG. 8.

A particular embodiment of the illumination device 202 is shown in FIG. 8. Illumination device 202 includes a multi-positional switch 204 extending outwardly therefrom near a front end 206 of the illumination device 202. Switch 204 is conveniently located such that a user's thumb can easily actuate the tape measure as well as illumination device 202 without repositioning the hand gripping tape measure/illumination device combination. The illumination device of FIG. 8 is shown in FIG. 9 incorporating receiving channels 210 similar to receiving channels 58 illustrated in FIG. 2.

An illumination device adapted for use with a tape measure device is particularly useful in a variety of applications. Due to the direction, color, and intensity of the above-described illumination means, a hand-held tape measure may be effectively utilized in limited light applications.

The illumination device of the present invention may also be utilized in conjunction with a variety of other objects, and in particular, in conjunction with various tools. Such tools may include, for example, tool boxes, saws, drills, nail guns, screw guns, and any other tool in which a portable illumination means would be helpful to perform its intended function in various lighting situations. Other objects that the illumination device of the present invention may be removably attached to include moving belts, walls, building studs, hard hats, or any other structure having sufficient surface area for the illumination device of the present invention to adhere to.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A self-contained portable illumination device, comprising:

(a) an outer frame having attachment means formed integrally therewith;

(b) illumination means disposed at least partially within said outer frame; and (c) distinct securing means specifically sized and configured to selectively matingly engage with said attachment means, said securing means being arranged to attach to selected objects, whereby said portable illumination device is selectively and removably attachable to such selected objects by matingly engaging with said securing means which are selectively attached to such objects.

2. A self-contained portable illumination device as in claim 1 wherein said attachment means comprises one or more slots specifically configured to receive corresponding protrusions on said universal attachment means.

3. A self-contained portable illumination device as in claim 1 wherein said illumination means comprises a plurality of individual light emitting diodes.

4. A self-contained portable illumination device as in claim 3 wherein said light emitting diodes are selected to emit a plurality of distinct predetermined light wavelengths.

5. A self-contained portable illumination device as in claim 4 wherein at least one light emitting diode illuminates in a green color wavelength.

6. A self-contained portable illumination device as in claim 1 wherein said outer frame is plastic.

7. A self-contained portable illumination device as in claim 1, including an actuating button on said outer frame for actuating said illumination means.

8. A self-contained portable illumination device as in claim 1 wherein said illumination means are powered by portable batteries stored within said outer frame.

9. A self-contained portable illumination device as in claim 1 being sized and configured to removably attach to a side surface of a tape measure, such that said portable illumination device does not interfere with the functionality of said tape measure.

10. A self-contained portable illumination device as in claim 1 wherein said objects include tape measures, tool boxes, clothing belts, walls, building studs, saws, drills, hard hats, nail guns and screw guns.

11. A self-contained portable illumination device as in claim 9 wherein said illumination means are directed to illuminate a measuring tape when extended from said tape measure.

12. A self-contained portable illumination device as in claim 11 wherein said illumination means emit a specific predetermined light wavelength to enhance illumination of said measuring tape.

13. A self-contained portable illumination device as in claim 12 including a green light emitting diode to enhance illumination of said measuring tape.

14. A self-contained portable illumination device as in claim 4 wherein said illumination means may be alternately switched to illuminate a target area using a first light wavelength, or to illuminate a general area using a second, different light wavelength.

15. A self-contained portable illumination device as in claim 1, including a multi-positional switch to alternately switch among said illumination means.

16. A method of illuminating a target zone, comprising:

(a) providing a portable illumination device having an outer frame, illumination means, and an attachment means formed integral with said outer frame, said illumination means including a plurality of light-generating means, each of which emit light in a distinct wavelength;

(b) providing a securing means that is sized and configured to matingly engaged with said attachment means;

(c) connecting said securing means to an object;

(d) removably and matingly engaging said attachment means to said securing means, thereby selectively and removably attaching said portable illumination device to the object; and (e) actuating said illumination means.

17. A method as in claim 16 wherein said attachment means is slidably received into said securing means.

18. A method as in claim 16 wherein said securing means is adhesively connected to said object.

19. A method as in claim 16 wherein said attachment means comprises one or more slots.

20. A method as in claim 19 wherein said securing means comprises one or more protrusions which are sized and configured to be received in said slots.

21. A method as in claim 16 wherein said light-generating means comprises a plurality of individual light emitting diodes.

22. A method as in claim 16, including an actuating button on said outer frame for actuating said illumination means.

23. A method as in claim 16 wherein said portable illumination device is sized and configured to removably attach to a side surface of a tape measure, and said illumination means are directed to illuminate a measuring tape when extended from said tape measure.

24. A method as in claim 22 wherein said actuating button comprises a multi-position switch to alternately switch among said illumination means.

* * * * *

UNITED STATES PATENT AND TRADEMARK OFFICE

CERTIFICATE OF CORRECTION

PATENT NO. : 6,626,555 B2
DATED : September 30, 2003
INVENTOR(S) : Rob Yaeger et al.

It is certified that error appears in the above-identified patent and that said Letters Patent is hereby corrected as shown below:

Title page,
Item [75], Inventors, add:

-- Andre R. Debrey
16231 Temple Drive North
Minnetonka, Minnesota 55345 --

Signed and Sealed this

Eighth Day of June, 2004

JON W. DUDAS
*Acting Director of the United States Patent and Trademark Office*